United States Patent [19]

Frisbee

[11] 4,023,624

[45] May 17, 1977

[54] BLADE ANGLE ADJUSTMENT MECHANISM FOR BULLDOZER OR THE LIKE

[75] Inventor: Claude M. Frisbee, Bettendorf, Iowa

[73] Assignee: J. I. Case Company, Racine, Wis.

[22] Filed: Aug. 19, 1976

[21] Appl. No.: 715,788

[52] U.S. Cl. ..... 172/805; 172/804

[51] Int. Cl.[2] ..... E02F 3/76

[58] Field of Search ..... 172/804, 805, 803, 806

[56] References Cited

UNITED STATES PATENTS

| | | | |
|---|---|---|---|
| 2,076,482 | 3/1937 | Thorpe | 172/805 |
| 2,777,222 | 1/1957 | Allin | 172/804 |
| 2,943,407 | 7/1960 | Long | 172/804 |
| 3,002,300 | 10/1961 | Turbyfill | 172/804 |
| 3,011,276 | 12/1961 | Likely | 172/804 |
| 3,059,356 | 10/1962 | Lorang | 172/804 |
| 3,521,714 | 7/1970 | Farris | 172/804 |
| 3,606,929 | 9/1971 | Frisbee | 172/804 |
| 3,662,838 | 5/1972 | Polzin | 172/804 |

*Primary Examiner*—Richard J. Johnson

*Attorney, Agent, or Firm*—Cullen, Settle, Sloman & Cantor

[57] ABSTRACT

An angle adjustment mechanism for a bulldozer blade or the like which simplifies the present hydraulic system, while permitting ease of operation. The opposed sides of the blade are connected to slides provided on the side frame members of the bulldozer, a rod-like element or beam having a plurality of spaced apertures is provided on each of the side frame members, at least one of which is slidably supported on the side frame member and a power extender such as a turnbuckle is connected to the slidable beam, permitting adjustment of the beam toward and away from the blade. A latch means such as a conventional latch pin is provided to lock the slides and thereby the blade in the desired position. The blade angle may then be adjusted by (1) releasing the latch means and the slides, (2) adjusting the blade angle, as by engaging an obstacle, (3) adjusting the position of the slidable beam with the power extender, and (3) locking the slides on the beams.

12 Claims, 6 Drawing Figures

BLADE ANGLE ADJUSTMENT MECHANISM FOR BULLDOZER OR THE LIKE

FIELD OF THE INVENTION

The present invention relates to bulldozers or the like having transversely extending blades and more particularly to means for adjusting the blade about a vertical axis, commonly referred to as angling.

The blade of the present commercial angling bulldozer is generally supported on a U or C-shaped frame. The blade is pivotally connected adjacent its ends to the sides of the bulldozer as shown in the U.S. Pat. No. 2,943,407 of Long, assigned to the Assignee of the instant application. As shown in the Long patent, the blade is supported adjacent its midportion to the center of the frame and the opposed sides of the blade are connected to hydraulic cylinders for angling of the blade. One hydraulic angle cylinder is extended and the opposed cylinder is retracted to angle the blade or adjust the blade about a vertical axis.

At present, there are two types of angling cylinders, including the solid-rod end mounted cylinders shown in the above referenced patent of Long and the hollow rod-trunnion mounted cylinders shown in my U.S. Pat. No. 3,606,929. In either arrangement, the hydraulic cylinders are relatively expensive and subject to failure when damaged. Although the present system is not intended to entirely replace the hydraulic angling bulldozers, an alternative system which does not require hydraulic cylinders or controls would be desirable.

So called "manually adjustable" bulldozer blades have long been available and are still available commercially. In a conventional manually adjustable blade, the side frame members of te bulldozers are provided with posts or apertures and the struts supporting the sides of the blade are secured to one of these connectors. The blade angle is adjusted by releasing the struts, rotating the blade about its vertical axis by engaging a ground obstacle and securing the struts to different connectors on the side frame members. It is often difficult however to resecure the struts to the frame connectors. The most common strut connection includes lower and upper struts connected to the lower and upper side corners of the blade, with the opposed strut ends joined forming a triangle. In bulldozing operations, the lower strut may be damaged or the alignment of the struts may be changed. Similarly, the alignment necessary for connection may be changed by the position of the blade, i.e. pitch, tilt, or damage to the side frame members or the strut connections. Whatever the reason, both connections to the frame can not be made without realignment or forcing one side of the blade to permit securement, which compounds the problem when the blade is to be angled to another position. Examples of prior art manually adjustable angle bulldozers include U.S. Pat. Nos. 2,777,222, 3,002,300, 3,059,356 and 3,662,838.

The blade angle adjustment mechanism of the present invention eliminates this problem by permitting adjustment of the position of the connectors, making it very simple to reconnect the blade in the desired position. Further, one embodiment of the angle adjustment mechanism of this invention may be utilized to provide fine adjustment of the blade angle without requiring hydraulic cylinders. Finally, the angle adjustment of the present invention may be utilized to provide an infinite variation in the blade angle, which is not possible with the present manually adjustable systems.

SUMMARY OF THE INVENTION

The angle adjustment mechanism of the present invention may be utilized in a conventional bulldozer having a side mounted frame, such as the U-shaped frame disclosed in the above referenced patent of Long, wherein the blade is mounted on the frame for angling movement about a vertical axis. The manually adjustable embodiment of the present invention is interchangeable with the present hydraulic system disclosed in my above referenced United States Patent, providing an alternative to the present hydraulic systems while permitting ease of adjustment of the blade.

The overall assembly then includes a vehicle, such as a bulldozer, a frame support for the blade having side frame members on opposed sides of the vehicle and a generally vertical blade transversely mounted on the vehicle frame for movement about a vertical axis or angling. The angle adjustment mechanism includes a slide member slidably mounted on each of the side frame members for extension toward and away from the blade. The slide members being connected to the adjacent side edges of the blade by suitable struts as shown in the above referenced patents. A rod-like element or beam is supported on each of the side frame members which include a plurality of spaced retainers. In the preferred embodiment, the retainers are apertures in the rods, however other retainers may also be utilized. At least one of the rods is slidably supported on a side frame member for extension toward and away from the blade and a power extender is connected to the slidable rod for adjustment of the relative position of the rod connectors. A suitable latch means is also provided which interlocks the slides to the rods in the desired position. Where the connectors are apertures, the latch means may be a simple latch pin.

In the simpliest embodiment of the invention, only one rod is slidably adjustable and the power extender is a conventional jack screw connected at one end to the slidable rod and at the opposed end to the side frame member. The blade angle may then be changed by releasing the latch pins, adjusting the angle of the blade to the desired position and securing the fixed rod and one slide. The slidable rod is then adjusted to align the rod connector with the opposed slide, which is then fixed by the second latch pin. The alignment problem between the struts and the connectors has thus been eliminated and the blade is easily secured in the new angle position.

In a second embodiment of the invention, both rods are slidably supported on the side frame members and each rod is connected to the frame by power extenders, permitting (1) ease of alignment between the struts and the connectors, and (2) further adjustment of the blade angle. It is thus possible to provide infinite angle adjustment for the blade. For example, the power extenders may be adapted to adjust the blade angle a distance equal to the distance between the connectors, whereby the blade may be fixed in one position and adjusted to the next connector.

Other features of the blade angle adjustment mechanism of the present invention permit ease of assembly and operation. In the preferred embodiments of the invention, the rods are supported above and parallel to the side frame members and extend through the slides for ease of locking the slides to the rods. The side frame members are provided with rails which slidably receive the slide members. The blade angle adjustment mechanism thus operates smoothly and efficiently.

Other advantages and meritorous features of the present invention will be more fully understood from the following description of the preferred embodiments, the appended claims and the drawings, a brief description of which follows.

DESCRIPTION OF THE PREFERRED EMBODIMENTS

Figures 1, 2, 3:
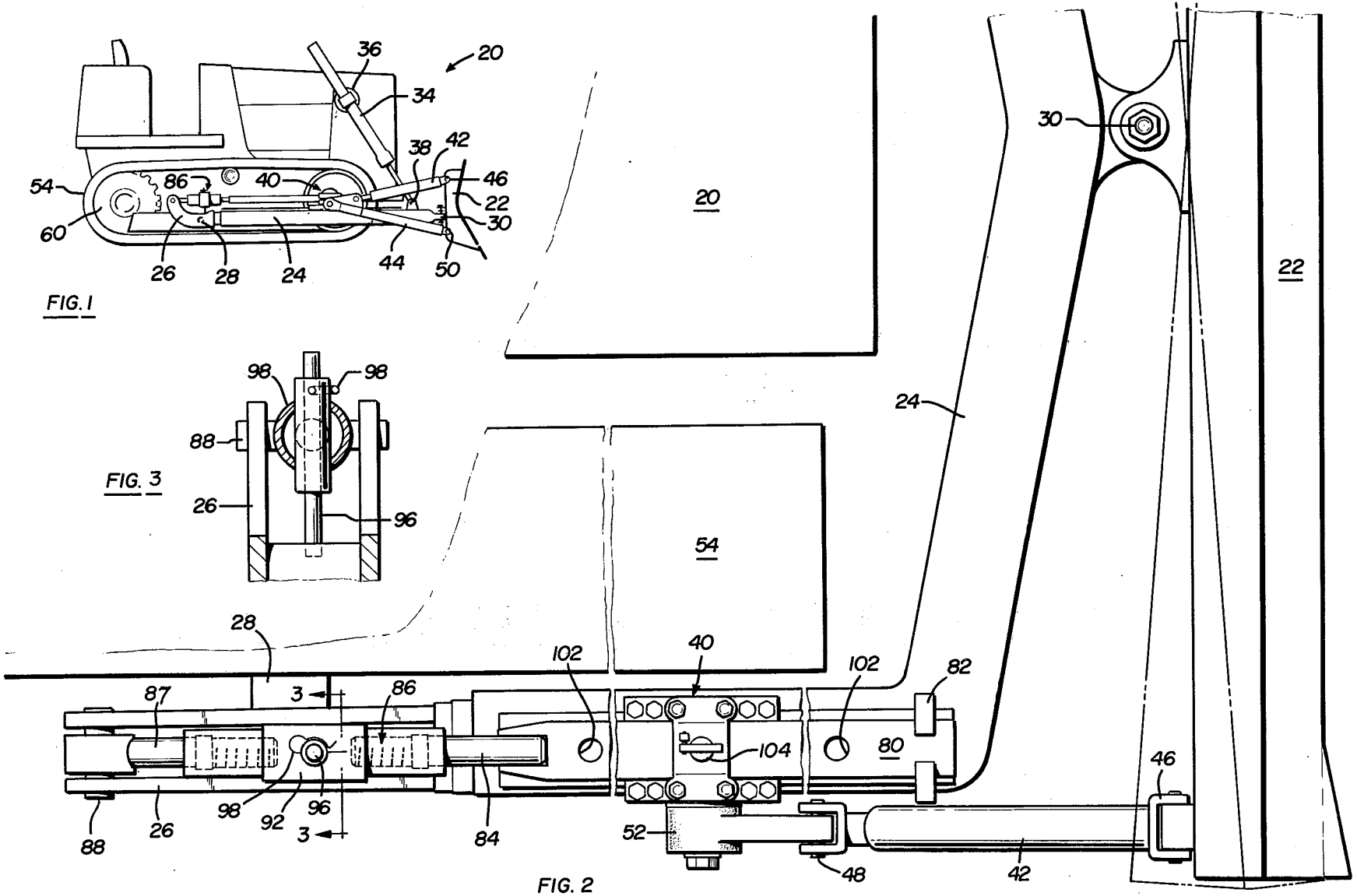
FIG. 1 is a side elevation of a conventional bulldozer having one embodiment of the angle adjustment mechanism of the present invention.
FIG. 2 is a partial top elevation of the blade angle adjustment mechanism shown in FIG. 1.
FIG. 3 is a cross-sectional view of the blade angle adjustment mechanism shown in FIG. 2, in the directions of view arrows 3—3.

FIG. 1 illustrates a conventional bulldozer 20 having one embodiment of the blade angle adjustment mechanism of the present invention. The assembly includes a generally vertical blade 22 which is mounted on a U-shaped frame 24 transverse to the longitudinal axis of the bulldozer, as shown in FIG.s 1 and 2. Each of the ends of the frame include a C-shaped trunnion bracket 26, as best shown in FIG.s 2 and 4 and the frame assembly is pivotally mounted on the bulldozer at 28 for raising and lowering the blade as described below. The center of the blade is mounted on the frame by a ball joint which permits the blade to be angled about a vertical axis, pitched and tilted as described in my above referenced patent. The disclosed embodiment of the bulldozer includes a pair of lift cylinders 34. The cylinder portion is mounted on the bulldozer by trunnion 36 and the rod portion is pivotally mounted to the frame by pivot joint 38. The blade may thus be raised and lowered by retacting or extending lift cylinders 34 which raise or lower the forward portion of the frame about pivot connections 28.

As described in more detail herein, each side of the blade is connected to a slide 40 which is slidably mounted on the side portions of the frame. The upper portion of the blade is connected to the slide by struts or tilt-pitch cylinders 42. The lower portion of the blade is connected to the slide by rigid struts. Where tilt-pitch cylinders are used, the cylinder portions are connected to the upper corners of the blade by pivot joints 46. The rod portion is pivotally connected to the slide bracket by pivot joints 48 as shown in FIG. 2. The lower struts are connected at one end 50 to the blade and the opposed end 52 is connected to the slide as shown in FIG.s 1 and 2.

The bulldozer blade may thus be pitched about a horizontal axis in the plane of the blade by simultaneously extending or retracting tilt-pitch cylinders 42 and adjusting the angle connections as described below. The blade may be tilted about the horizontal longitudinal axis of the bulldozer by extending one tilt-pitch cylinder and retracting the opposed cylinder. The bulldozer is supported on track 54 which is driven by sprockets 60. it will be understood that FIG. 1 illustrates only one embodiment of a bulldozer and that the blade angle adjustment mechanism of the present invention may be utilized in other bulldozers or vehicles having an angling blade. The bulldozer of FIG. 1 does illustrate a particular problem with the prior art manually adjustable blades. As stated above, the center of the blade is supported on a ball joint 30 to permit pitching and tilting of the blade. Therefore, if the struts 42 and 48 were released, as shown in the prior art, the blade would be completely free and there would be a substantial danger of the blade pitching forward, causing injury or damage. This problem has been eliminated in the manually adjustable blade of the present invention by attaching the struts to a slide 40 and releasing the slides rather than the struts as described hereinbelow.

The slides 40 are each retained on the frame side portions 24 by a T-shaped track or rail 60 as shown in FIG.s 4 and 5. The rail includes an upper horizontal portion 62 and a lower portion 64. The slides each include a body portion 66 having a channel which receives the upper portion 62 of the track and retainer portions 68 which are received beneath the top portion 62 of the rail and are bolted in place by bolts 70. The bolts slidably secure the slide members 40 on the side frame members. The slides include a cover portion 72 which is bolted by bolts 74 to the body portion 66. As shown in FIG.s 4 and 5, the cover 72 and body portion 66 define a spherical chamber which rotatably secures a ball 76. The ball may be either solid or split and slidably retains the rods or beams 80.

Figure 4:
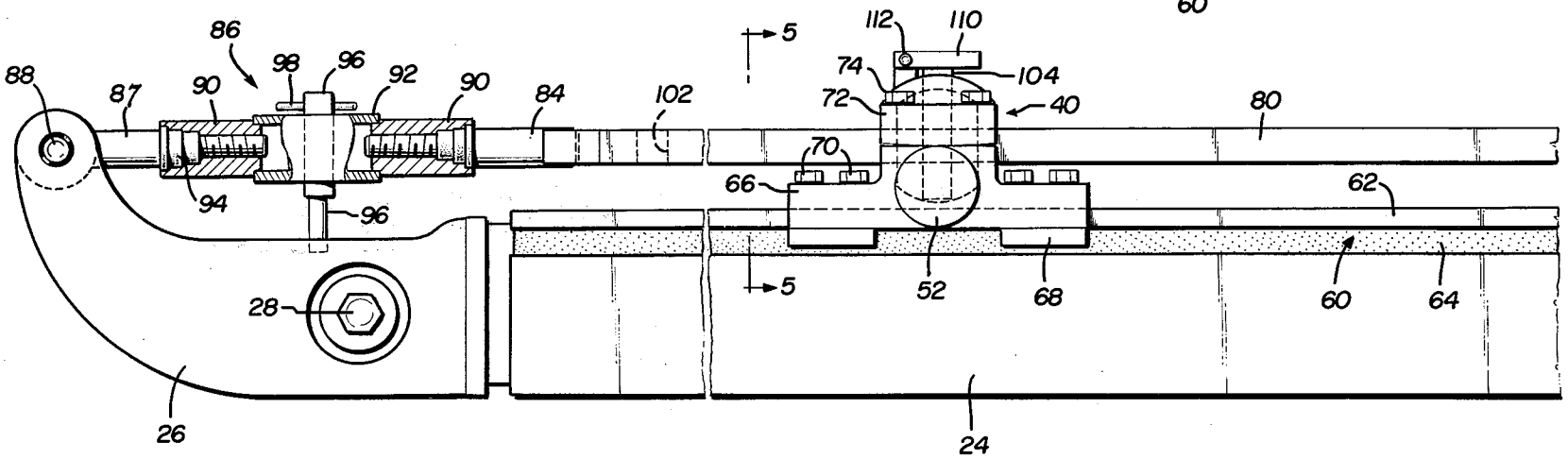
FIG. 4 is a partial side elevation of the blade angle adjustment mechanism shown in FIG. 2.

The slide member 80 is slidably supported at one end by slide bracket 82 as shown in FIG. 2. The opposed end of the beam is connected to rod 84 of turnbuckle 86 as shown in FIG.s 2 and 4. The oppositedly threaded rod 87 of the turnbuckle is pivotally connected to trunnion bracket 26 by pivot pin 88. The turnbuckle includes cylindrical internally threaded portions 90 and a central housing portion 92 which may be welded to the internally threaded portions 90. Each of the threaded portions 90 include a journaled portion 94 which receives the rod portions of the turnbuckle as shown in FIG. 4. As shown, the rods 84 and 87 are oppositedly threaded, such that rotation of the turnbuckle housing will slidably extend beam 80 toward or away from the bulldozer blade 22. A anti-rotation pin 96 may be received through the housing portion 92 to prevent accidental rotation of the turnbuckle. A lock pin 98 is provided to prevent the anti-rotation pin 96 from falling through the turnbuckle housing.

Figure 5:
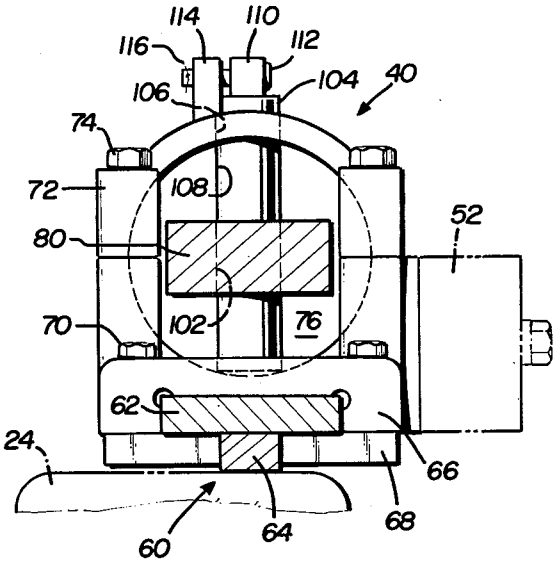
FIG. 5 is a cross-sectional view of the blade adjustment mechanism shown in FIG. 4, in the direction of view arrows 5—5.

As described above, beam 80 includes a plurality of spaced apertures 102 which receive latch pin 104, which locks the slide 40 in the desired location. The latch pin is received through an aperture 106 in the housing cover 72, through aperture 108 in ball member 76 and finally through aperture 102 in the beam 80 as shown in FIG. 5. A cross member 110 is welded or otherwise secured to latch pin 104, which is secured to the housing by cross pin 112. The cross pin is received through an aperture in housing flange 114 and locked in place by cotter pin 116.

Figure 6:
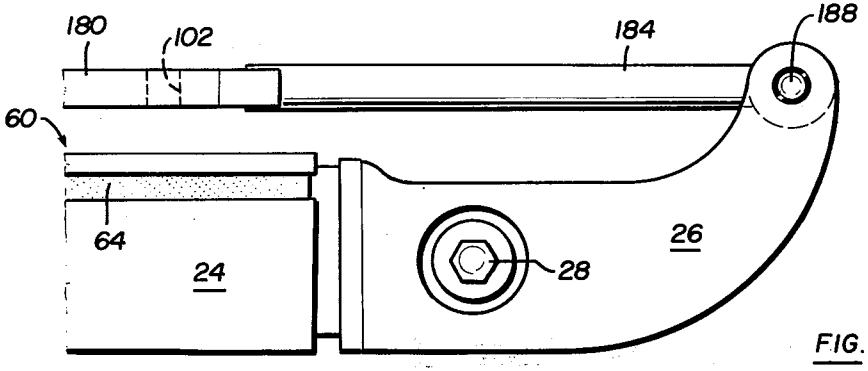
FIG. 6 is a partial side view of the opposed side of FIG. 1 in one embodiment of the invention.

In the simpliest embodiment of the blade angle adjustment mechanism of this invention, the opposed rod or beam 180 is pivotally connected to the frame trunnion bracket 26 as shown in FIG. 6. The rod 180, which may be identical to rod 80, is connected to a second rod 184 which is pivotally connected by pin 188 to the trunnion bracket. As shown in FIG. 6, the turnbuckle 86 has been eliminated, however the other details of the assembly are as shown in FIG. 4, including the apertures 102 in the beam 180, the slide assembly 40, etc. The blade in this embodiment is then angled, as follows.

First, the latch pins 104 are removed by removing cotter pins 116 and removing the latch pin assembly. The slide members 40 are now free to move on the tracks or slides 60. The blade is then "manually" turned about the vertical axis of ball joint 30 by engaging one side of the blade 22 against an obstacle, such as a stump. Where the blade is to be angled to the left, the left hand side of the blade is engaged against the obstacle and the bulldozer is moved forwardly. The latch pin is then secured in the rigid beam 180, which is on the left side of the bulldozer shown in FIG. 1. It will be understood that the slidable beam 80 and turnbuckle 86 may be utilized on either side of the bulldozer. The slidable beam 80 is then adjusted toward or away from the blade by rotating turnbuckle 86 in a clockwise or counter-clockwise direction until the aperture 106 in the housing accurately aligns with one of the apertures 102 in the beam 80. This may be easily accomplished by one man by placing the latch pin 104 in aperture 106 and operating the turnbuckle 86 until the latch pin falls in place. As described, the anti-rotation pin 96 must be removed from the turnbuckle prior to rotating the turnbuckle housing. The latch pin 104 is then secured in place by disposing cross pin 112 in the aperture in flange 114 and securing the latch pin with cotter pin 116. The bulldozer is then ready for operation in the new angled position. Slide 40 in FIG. 4 is fully extended indicating that the blade of FIG. 1 is angled to the left. The slide 40 in FIG. 2 is in the center position, indicating that the blade is perpendicular to the longitudinal axis of the bulldozer, as shown.

In one alternative embodiment, the opposed blade angle adjustment mechanisms are identical. That is, each side includes a turnbuckle 86 as shown in FIG.s 2 and 4. Each of the beams 80 may therefore be slidably adjusted to adjust the bulldozer blade angle. Where the bulldozer blade is relatively light, the blade angle may be adjusted by turnbuckles 86; one turnbuckle being extended and the opposed turnbuckle being retracted. Alternatively, relatively light hydraulic cylinders may be utilized as the power extender, or more preferably, a grease cylinder may be utilized which is extended by injecting grease in the cylinder to be extended with a grease gun. As will be understood, various power extenders or power means my be utilized. Where the power extender is adapted to extend the slide from one connector 102 in the beam to the next, infinite adjustment of the blade is possible with a relatively simple adjustment mechanism. The blade would then be angled by extending one power extender 86 and retracting the opposed extender approximately the distance between the adjacent connectors, which in FIG. 2 are apertures 102. The latch pins 104 would then be retracted and the power extender retracted to its original position and the latch pins reinserted. Where the blade is relatively heavy and turnbuckles are utilized, the latch pins are removed, the blade manually adjusted as described above, and the beams 80 are adjusted to receive both latch pins 104. Thereafter, a small adjustment of the blade is still possible where two turnbuckles or other power extenders are utilized.

In the embodiment of the bulldozer shown in FIG. 1, the lower strut connections 50 are preferably spaced below the center ball joint 30 to provide support for the lower blade corners during dozing and prevent the frame 24 from dragging. As described above, in the simpliest embodiment of the bulldozer, the upper blade connections 42 are rigid struts, however hydraulic tilt-pitch cylinders may also be utilized to permit hydraulic tilting and pitching of the bulldozer blade. However, where the blade of FIG. 1 is pitched about the horizontal axis, the lower strut connections 50 will also be moved because the blade connections are not aligned. This problem can be avoided by either aligning the blade connections 30 and 50 or adjusting the angle control as described below. For example, the upper edge of the blade of the bulldozer shown in FIG. 1 may be pitched forwardly by releasing the latch pins 104 and extending the tilt-pitch cylinders 42. The beams 80 are then retracted to compensate for the rearward movement of strut connections 50 by operation of jack screws 86 as described above. The slides 40 are then reconnected to the beams by the latch pins.

As described above, the blade angle adjustment mechanism of the present invention is fully interchangeable with present hydraulic angle systems, thereby providing an alternative and less expensive system. Th beam-slide assembly assures that the blade may be resecured in a new angle position without forcing the blade or deflecting the strut connections 42 and 44. The blade may be angled and easily secured with only one operator, which is not possible in many of the prior art manual angle dozers, particularly after months of use. It will be understood that various modifications may be made to the embodiments of the blade angle adjustment mechanism disclosed in this application. For example, the beam 80, which is rectangular in the disclosed embodiment as shown in FIG. 5, may be a cylindrical rod. In the disclosed embodiment, three apertures 102 are provided in the beam 80, permitting the blade to be angled to either side or positioned perpendicular to the longitudinal axis of the bulldozer. The number of connectors may however be increased, permitting finer adjustment of the blade angle. Similarly, as described above, various power extenders may be utilized, however the turnbuckle 86 disclosed in this application eliminates the requirement for hydraulic cylinders, which is a particular advantage of the blade angle adjustment mechanism of the present invention.

I claim:

1. An angle adjustment mechanism for a blade mounted on a vehicle, the assembly including a vehicle, a blade transversely mounted on said vehicle for angling movement about a vertical axis, slide rails on opposed sides of said vehicle and a slide member slidably supported on each slide rail, said slide members each connected to the adjacent side of said blade, said angle adjustment mechanism comprising an elongated beam on each side of said vehicle having a plurality of spaced retainer means, latch means for selectively locking said slide members on one of said beam retainer means, and a power means connected to one of said beams adjusting said one beam toward or away from said blade, whereby said blade may be angled by (a) releasing said latch means (b) adjusting the angle of said blade, (c) adjusting the position of said one beam with said power means, aligning said retainer means with said slide and (d) locking said slides on said beams and thereby locking the angular position of said blade.

2. The blade angle adjustment mechanism defined in claim 1, characterized in that said beams are supported on opposed sides of said vehicle above and parallel to said rails.

3. The blade angle adjustment mechanism defined in claim 2, characterized in that said beams extend through said slides and said latch means includes a latch pin which extends through one of a plurality of spaced apertures on said beam defining said retainer means.

4. The blade angle adjustment mechanism defined in claim 1, characterized in that said blade is supported on a U-shaped frame having side frame members including said slide rails, said beams being supported on said frame and at least one of said beams slidably supported on said side frame members and said power means interconnecting said one beam and said frame, slidably adjusting said beam on said frame toward and away from blade.

5. The blade angle adjustment mechanism defined in claim 4, characterized in that said beams are supported above and parallel to said rails.

6. The blade angle adjustment mechanism defined in claim 4, characterized in that said power means is a turnbuckle having one end connected to said frame and the opposed end connected to said one beam.

7. The blade angle adjustment mechanism defined in claim 1, characterized in that said blade is supported on a frame having side members on opposed sides of said vehicle, said rails defined on said side frame members, said beams slidably supported on said side frame members and said power means interconnecting said slide members and said beams for extending or retracting said beams.

8. An angle adjustment mechanism for a blade, the assembly including a vehicle, a frame support having side frame members on opposed sides of said vehicle and a generally vertical blade transversely mounted on said vehicle frame, said angle adjustment mechanism comprising;

a slide member slidably mounted on each of said side frame members for extension toward and away from said blade, each of said slide members operably connected to the adjacent sides of said blade, a rod supported on each of said side frame members, at least one of said rods slidably supported on a slide frame member, said rods having a plurality of spaced retainer means, latch means interconnecting said slide members and said rod retainer means and a power extender interconnecting said one slidable rod and said side frame member for extending said one rod toward or away from said blade, whereby said blade may be angled by (a) releasing said latch means, (b) adjusting the angle of said blade, (c) adjusting said one rod to align said retainer means and said slide and (d) locking the slides to the rods to fix the angular position of said blade.

9. The blade angle adjustment mechanism define in claim 8, characterized in that said rods are supported above and parallel to said vehicle side frame members.

10. An angle adjustment mechanism for a vehicle blade, the assembly including a vehicle, a frame support for said blade having side frame portions on opposed sides of said vehicle and a generally vertical blade transversely mounted on said vehicle frame, said angle adjustment mechanism comprising:

a slide member slidably mounted on each of said side frame members for sliding extension toward and away from said blade, said slide members operably connected to the adjacent sides of said blade, a rod supported above and generally parallel to each of said side frame members, with at least one rod slidably supported for movement toward and away from said blade, said rods having a plurality of spaced apertures, latch means including a latch pin retaining said slide members in one of said rod apertures and a power extender interconnecting said one slidably supported rod and said frame for extending said rod toward and away from said blade.

11. The blade angle adjustment mechanism defined in claim 10, characterized in that said rods extend through said slide members, said slide members being slidable along said rods and said latch pins being extendable through said slides and said rods to lock the slides on said rods.

12. The angle adjustment mechanism defined in claim 10, characterized in that said power extender is a turnbuckle connected at one end to said one slidably supported rod and connected at the opposed end to one of said side frame members.

* * * * *